US009022809B2

(12) United States Patent
Tang et al.

(10) Patent No.: US 9,022,809 B2
(45) Date of Patent: May 5, 2015

(54) CARD EDGE CONNECTOR

(71) Applicant: Hon Hai Precision Industry Co., Ltd., New Taipei (TW)

(72) Inventors: Wen-Jun Tang, Kunshan (CN); Xue-Wu Bu, Kunshan (CN); Chi-Tung Mo, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 109 days.

(21) Appl. No.: 13/846,933

(22) Filed: Mar. 18, 2013

(65) Prior Publication Data

US 2013/0252449 A1 Sep. 26, 2013

(30) Foreign Application Priority Data

Mar. 20, 2012 (CN) ..... 2012 2 0104423

(51) Int. Cl.
*H01R 24/00* (2011.01)
*H01R 12/72* (2011.01)
*H01R 12/71* (2011.01)

(52) U.S. Cl.
CPC ..... *H01R 12/721* (2013.01); *H01R 12/716* (2013.01)

(58) Field of Classification Search
USPC ..... 439/160, 637, 630
See application file for complete search history.

(56) References Cited

U.S. PATENT DOCUMENTS 4,298,237 A * 11/1981 Griffith et al. ..... 439/60
4,993,972 A * 2/1991 Lin ..... 439/637
5,580,257 A * 12/1996 Harwath ..... 439/108
6,254,435 B1 * 7/2001 Cheong et al. ..... 439/637
6,309,254 B1 * 10/2001 Korsunsky ..... 439/637
6,315,615 B1 * 11/2001 Raistrick ..... 439/637
6,558,173 B1 * 5/2003 Choy ..... 439/108
6,558,200 B1 * 5/2003 Choy ..... 439/637
6,575,774 B2 * 6/2003 Ling et al. ..... 439/108
6,655,976 B1 12/2003 Shipe et al.
6,832,933 B2 * 12/2004 Bu et al. ..... 439/637
RE38,736 E * 5/2005 Walse et al. ..... 439/60
7,083,423 B1 * 8/2006 Guerra et al. ..... 439/62
7,156,701 B1 * 1/2007 Pennypacker et al. ..... 439/637
7,210,955 B2 * 5/2007 Ringler et al. ..... 439/381
7,658,628 B2 * 2/2010 Guan et al. ..... 439/157
7,938,657 B2 * 5/2011 Tang et al. ..... 439/160
7,946,875 B2 * 5/2011 Li et al. ..... 439/327
7,976,345 B2 * 7/2011 Szczesny ..... 439/637
8,052,450 B2 * 11/2011 Li et al. ..... 439/327
8,215,994 B2 * 7/2012 Duenas et al. ..... 439/637
8,535,077 B2 * 9/2013 Shen et al. ..... 439/328
8,550,855 B2 * 10/2013 Zhang et al. ..... 439/636
8,622,763 B2 * 1/2014 Fu et al. ..... 439/328
8,715,009 B2 * 5/2014 Wu et al. ..... 439/637
2003/0203679 A1 * 10/2003 Bu et al. ..... 439/637
2007/0155245 A1 * 7/2007 Tsai ..... 439/637

(Continued)

*Primary Examiner* — Ross Gushi
(74) *Attorney, Agent, or Firm* — Wei Te Chung; Ming Chieh Chang

(57) ABSTRACT

A card edge connector (100) for mounted on a PCB (200) includes a longitudinal insulative housing (1) and a plurality of contacts (2, 6) arranged two arrays opposite to each other in the width direction. Each of the contacts has a retaining portion (24, 64), a contacting portion extending from the retaining portion and a soldering tail (66) extending outwards for being soldered to the PCB (200). The retaining portion (24, 64) of each array contact are coplanar to each other and disposed at a vertical plane in the longitudinal direction, while the soldering tails (26, 66) of each array contact are arranged at least three tail lines (L1, L2, L3).

19 Claims, 9 Drawing Sheets

(56) References Cited

U.S. PATENT DOCUMENTS

| | | | | |
|---|---|---|---|---|
| 2008/0220637 | A1* | 9/2008 | Guan et al. | 439/157 |
| 2008/0220654 | A1* | 9/2008 | Guan et al. | 439/629 |
| 2009/0023308 | A1* | 1/2009 | Guan et al. | 439/62 |
| 2010/0105248 | A1* | 4/2010 | Tang et al. | 439/630 |
| 2011/0053400 | A1* | 3/2011 | Li et al. | 439/327 |
| 2011/0177707 | A1* | 7/2011 | Li et al. | 439/327 |
| 2012/0094542 | A1* | 4/2012 | Duenas et al. | 439/630 |
| 2013/0252449 | A1* | 9/2013 | Tang et al. | 439/325 |

* cited by examiner

CARD EDGE CONNECTOR

BACKGROUND OF THE INVENTION

1. Field of the Invention

The present invention relates to a card edge connector, and more particularly to a card edge connector with improved arrangement of plurality of contacts terminals.

2. Description of the Related Art

Card edge connector is usually assembled on a mother board and then engages with a daughter board for interconnecting between the two boards. U.S. Pat. No. 6,309,254 issued to Korsunsky on Oct. 30, 2001, discloses a card edge connector having an insulative housing and a plurality of blanking contacts retained in the insulative housing. The insulative housing defines an inserting slot for receiving the daughter board. Each of the contacts includes a retaining portion retained in the sidewall, a contacting portion extending into the inserting slot from one end of the retaining portion for contacting with the daughter board and a soldering tail extending outwards to the insulative housing from another end of the retaining portion for connecting with and extending through the mother board. The contacting portions of the contacts are arranged in two rows in a width direction of the sidewall, respectively being received in two sidewalls disposed at both sides of the inserting slot. The soldering tails are arranged in three rows in the width direction.

However, the blanking contact is cut from a metal plate and shows a flat shape, thereby occupying more space in the width direction and generating more metal off-cuts after making the blanking contact. So the making process of the blanking contacts doesn't accord with the present technology trend of cost down.

Therefore, an improved card edge connector are desired to overcome the disadvantages of the related arts.

SUMMARY OF THE INVENTION

An object of the present invention is to provide a card edge connector with advantage of cost down because of improved contacts thereof.

In order to achieve the above-mentioned object, a card edge connector for mounted on a printed circuit board (PCB) in accordance with a preferred embodiment of the present invention includes a longitudinal insulative housing and a plurality of contacts arranged two arrays opposite to each other in the width direction. Each of the contacts has a retaining portion, a contacting portion extending from the retaining portion and a soldering tail extending outwards for being soldered to the PCB. The retaining portions of each array contact are coplanar to each other and disposed at a vertical plane in the longitudinal direction, while the soldering tails of each array contact are arranged at least three tail lines.

Other objects, advantages and novel features of the invention will become more apparent from the following detailed description of the present embodiment when taken in conjunction with the accompanying drawings.

DETAILED DESCRIPTION OF THE INVENTION

Figure 1:
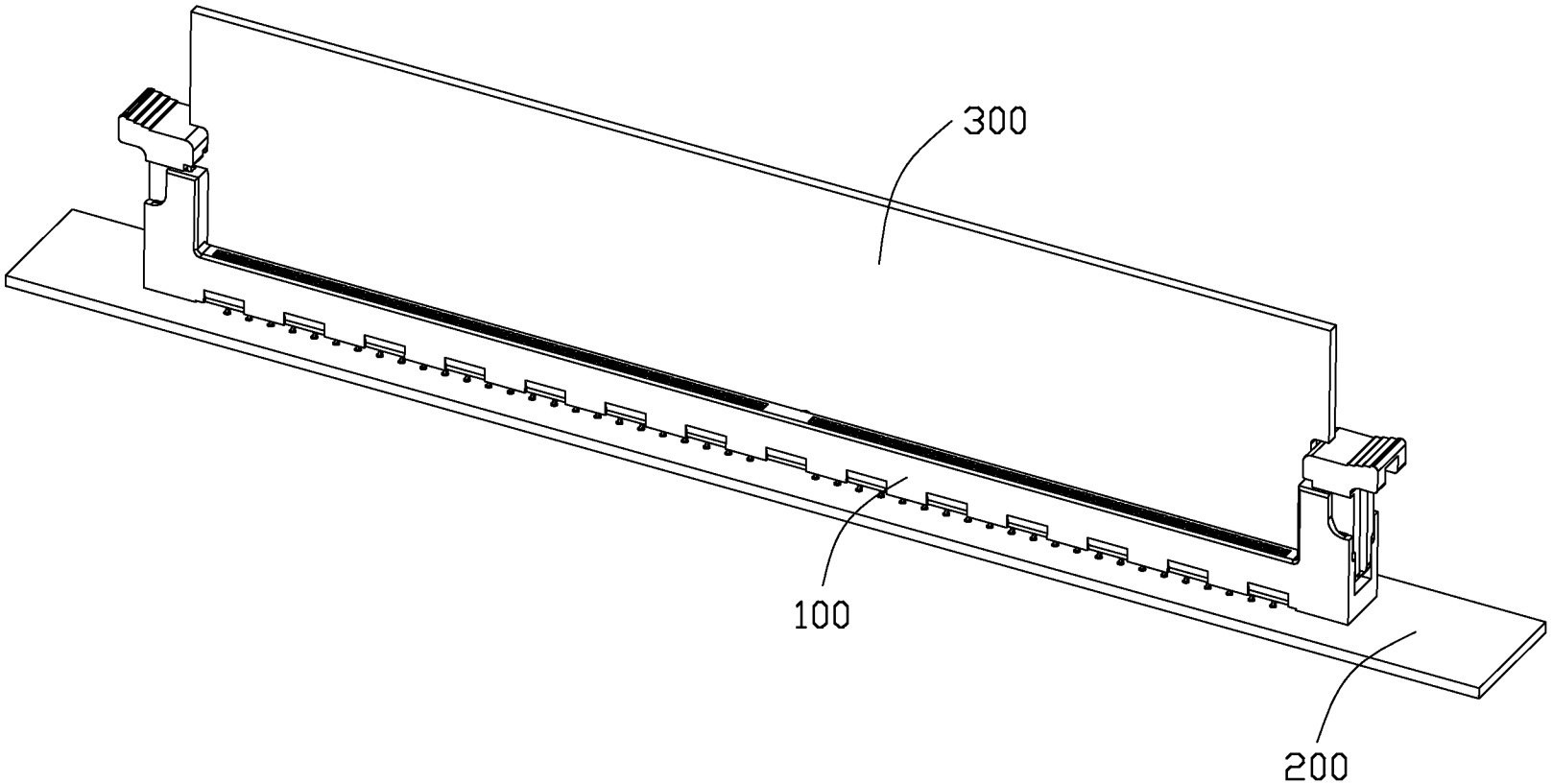
FIG. 1 is a perspective view of a card edge connector which is mounted on a PCB and engages with a memory module in accordance with the preferred embodiment of the present invention.

Reference will now be made to the drawing figures to describe the preferred embodiments of the present invention in detail.

Figure 2:
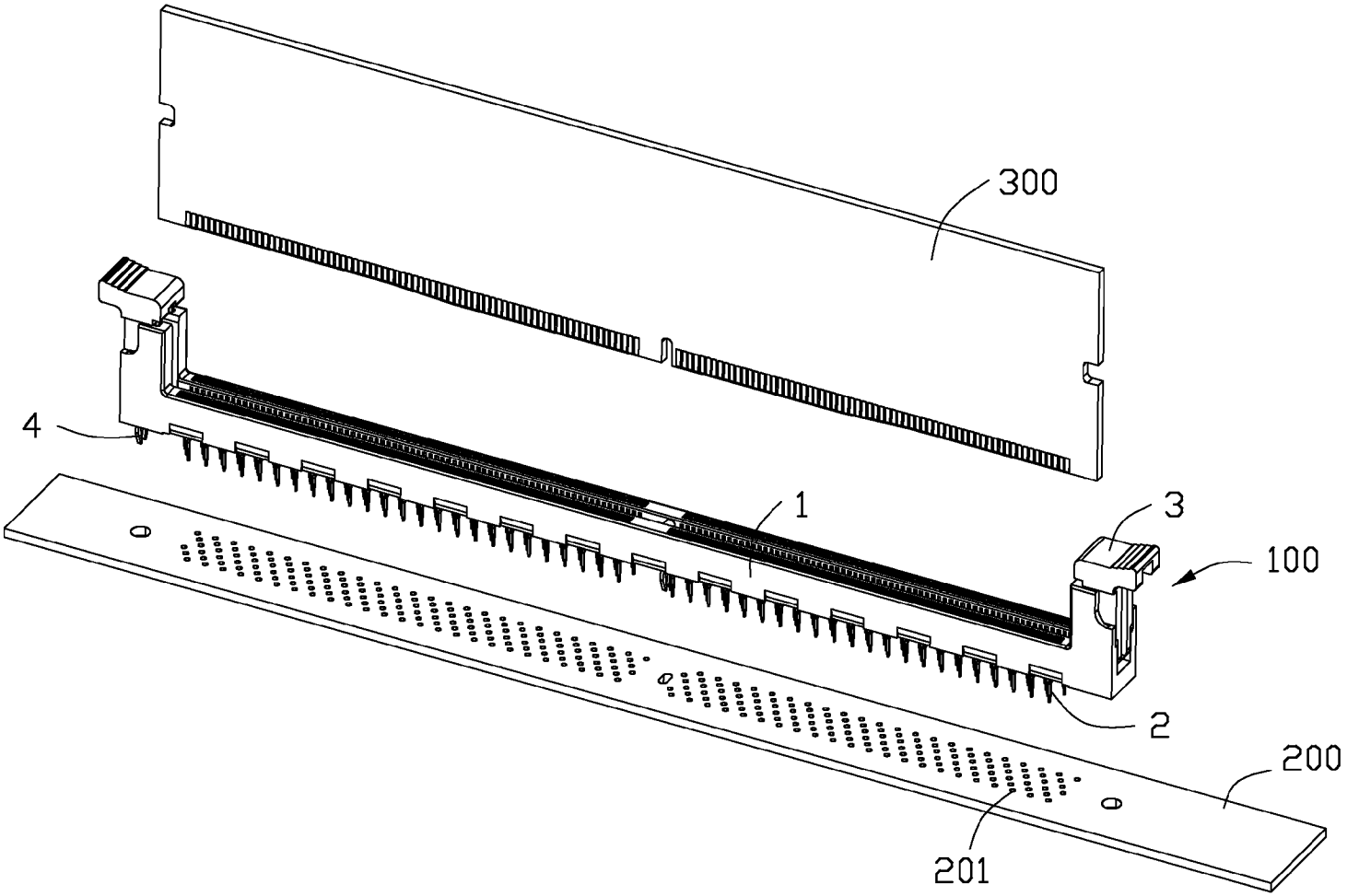
FIG. 2 is a perspective view of the card edge connector, the PCB and the memory module disengaging with each other shown in FIG. 1.

Referring to FIGS. 1 to 2, a card edge connector 100 is mounted on a printed circuit board (PCB) 200 and then engages with a memory module 300 for interconnecting between both thereof. The card edge connector 100 includes a longitudinal insulative housing 1, a plurality of contacts 2 retained in the longitudinal insulative housing 1, a latch 3 movably engaged with the insulative housing 1 and a board lock 4 retained on bottom of the insulative housing 1 for positioning the card edge connector 100 on the PCB 200.

Figure 3:
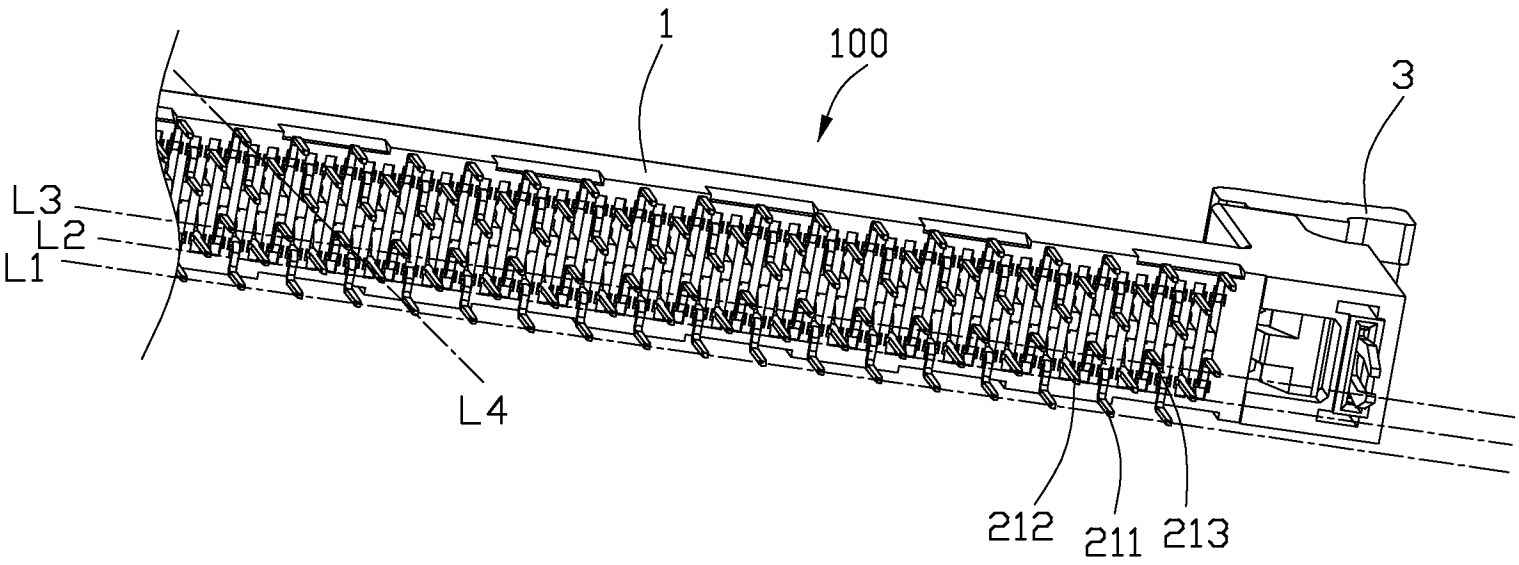
FIG. 3 is a partly perspective view of the card edge connector shown in FIG. 2 viewed from bottom side thereof.
Figure 4:
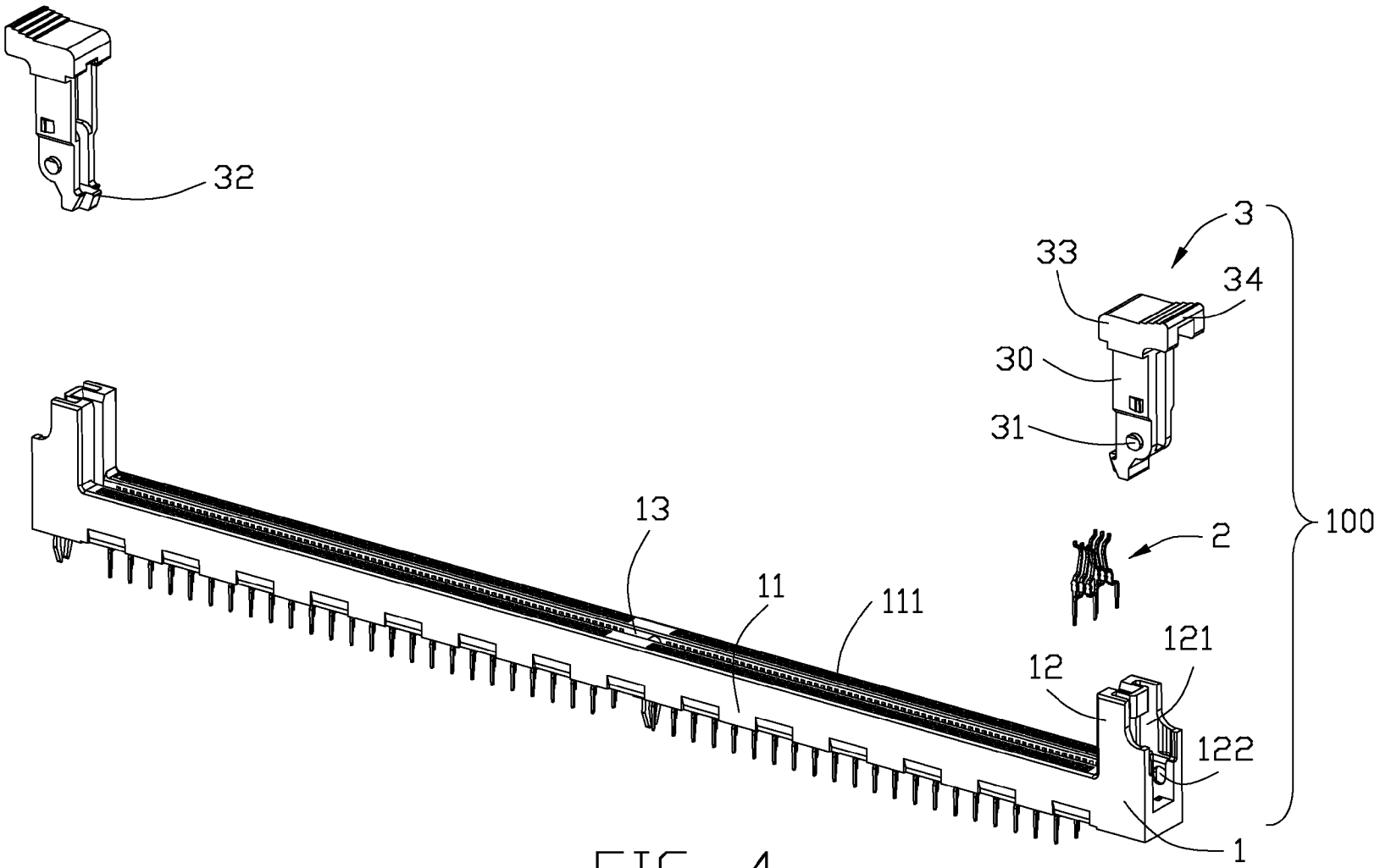
FIG. 4 is an exploded perspective view of the card edge connector of FIG. 2.

Referring to FIGS. 3 to 4, the insulative housing 1 includes a pair of longitudinal sidewalls 11 opposite to each other in a width direction thereof and a pair tower portion 12 upwards integrally protruding from both ends of the sidewalls 11, thereby forming an inserting slot 13 for receiving the memory module. The tower portion 12 has a receiving opening 121 for receiving the latch 3 and a pair of engaging recesses 122 concaved from two opposite inwalls of the receiving opening 121. The latch 3 is mounted into the receiving opening 121 and includes a base portion 30, a pair of rotating shafts 31 protruding from both sides of the base 30 and being disposed at the engaging recess 122 for making the latch 3 pivoting therein between an locking station and a unlocking station, an pushing portion 32 extending towards the insertion slot 13 from one end of the base portion 30 in the unlock station for pushing outwardly the memory module, a locking portion 33 extending towards the insertion slot 13 from another end of the base portion 30 for locking the memory module in the locking station and an operating portion 34 disposed at opposite end of the locking portion 33.

Figure 5:
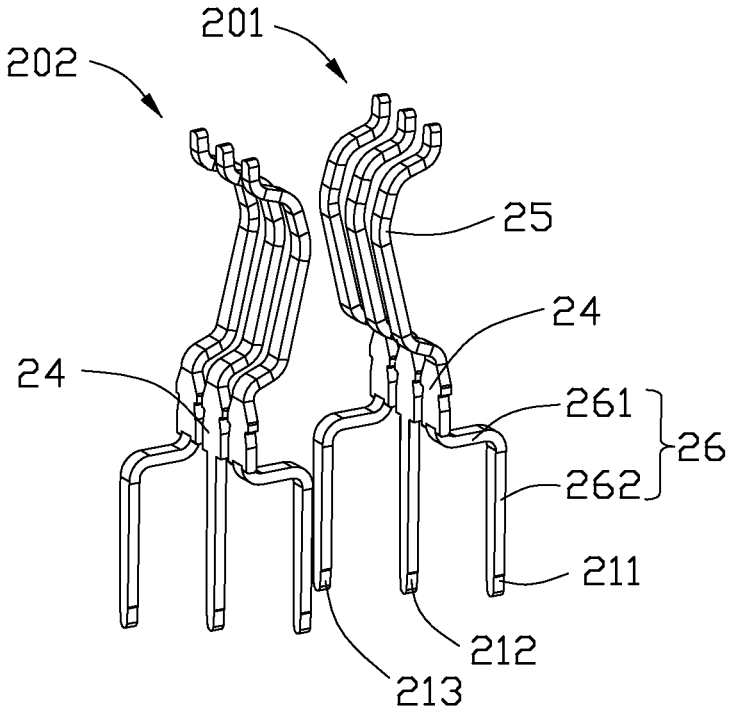
FIG. 5 is perspective view of a part of contacts of the card edge connector shown in FIG. 4.
Figure 6:
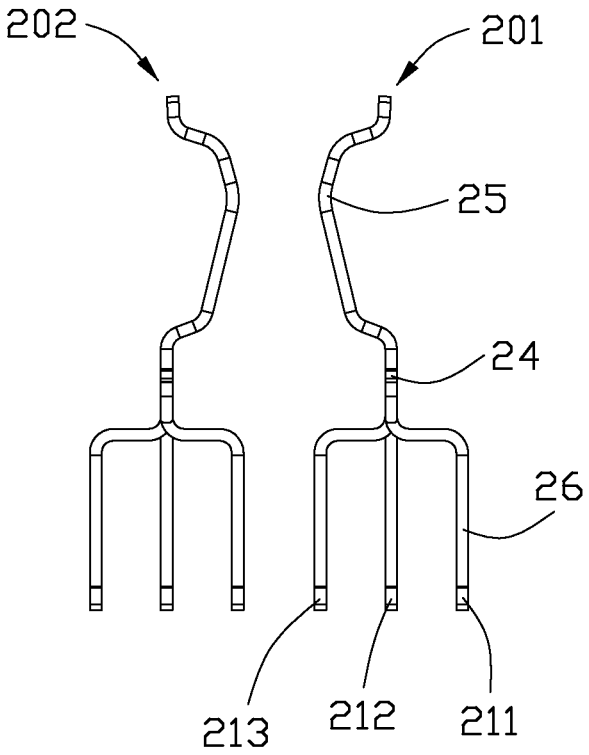
FIG. 6 is side view of the contacts shown in FIG. 5.
Figure 7:
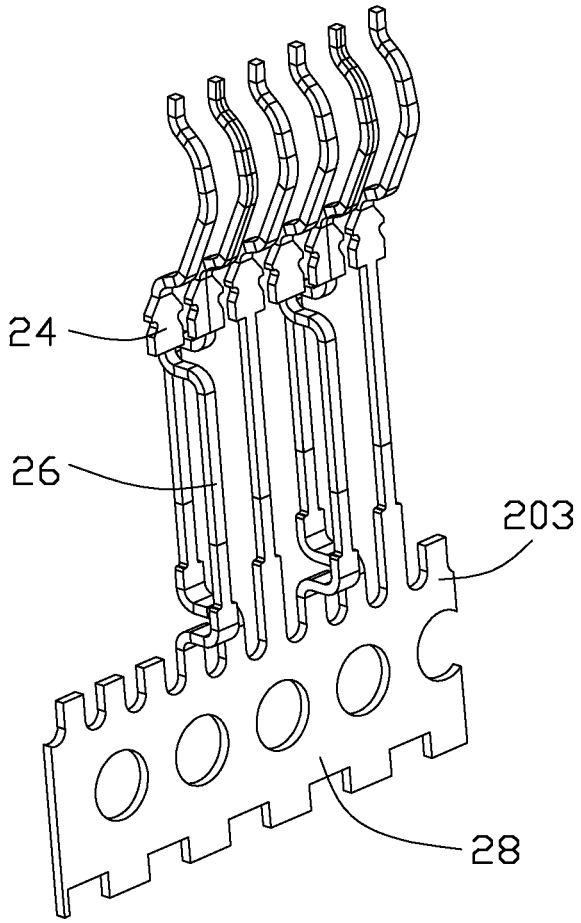
FIG. 7 is perspective view of the contacts shown in FIG. 5 before cutting from a metal plate.

Referring to FIGS. 5 to 7, the insulative housing 1 defines a plurality of receiving grooves 111 for receiving the contacts 2 therein. The contacts 2 are arranged two arrays along a longitudinal direction, while opposite to each other in the width direction, respectively being disposed at both sidewalls 11. Each of the contacts 2 includes a retaining portion 24 retained in the insulative housing 1, a contacting portion 25 extending into the inserting slot 13 upwardly from one end of the retaining portion 24 for contacting with the memory module and a soldering tail 26 extending outwards from another end of the retaining portion 21 for being soldered to the PCB. Each array of the contacts 2 is formed of the same metal plate 203 in which their retaining portions 24 are coplanar to each other and disposed at a vertical plane in the longitudinal direction.

The two arrays contacts 2 respectively define a plurality of first contact units 201 and a plurality of second contact units 202. The first contact unit 201 is formed of a first contact 211, a second contact 212 and a third contact 213 adjacent to each other, in which the second contact 212 is disposed between the first contact 211 and the third contact 213. The soldering tail 26 of second contact 212 is coplanar to the retaining portion 24 thereof. Furthermore, in the width direction the soldering tail 26 of second contact 212 is between of or even at middle of the soldering tails 26 of the first contact 211 and the third contact 213, because the latter two soldering tails 26 respectively bend and deviate from the retaining portion 24 thereof towards opposite direction which are not coplanar to the retaining portion 24 thereof. The soldering tails 26 of the first contact 211 forms a horizontal portion 261 bending and extending perpendicularly from the retaining portion 24 and a vertical portion 262 extending downwards perpendicularly from the horizontal portion 261 for inserting into and soldering with the PCB. Furthermore, the soldering tail 26 of the third contact 213 also has a horizontal portion 261 and a vertical portion 262 which are symmetry to the first contact 211. The arrangement and structure of the soldering tails 26 in the first contact unit 201 and the second contact unit 202 are the same.

Referring to FIG. 3, in the longitudinal direction the soldering tails 26 of the three types contacts 2 are respectively arranged a tail line L1, L2, L3. The tail lines L1, L2, L3 are parallel to each other and the tail line L2 is sandwiched between the tail lines L1 and L3. The solder tails 26 of each first contact unit 201 is arranged another tail line L4 which intersect with the tail lines L1, L2, L3 and alignment to the solder tails 26 of the second contact unit 202 on the diagonally opposite side thereof.

Referring to FIG. 7, the contacts 2 are cut from the metal plate 203 and bended above-mentioned required structure. A strip portion 28 connects with the end of the soldering tail 26 and break off finally from the soldering portion 26 in the width direction, after the contacts 2 are inserted into the insulative housing 1. As a result of the above-mentioned contacts 2, it could decrease the material used for contacts 2 for cost down and improve the lay-out of the PCB 200.

Figure 8:
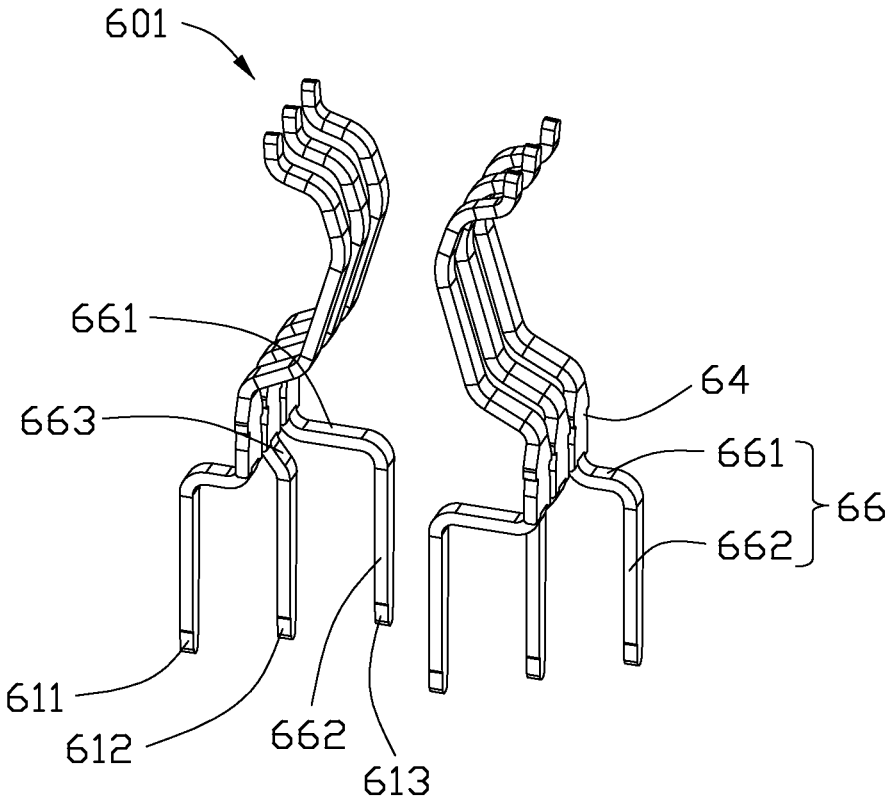
FIG. 8 is a perspective view of a part of contacts of a card edge connector in accordance with another preferred embodiment of the present invention.
Figure 9:
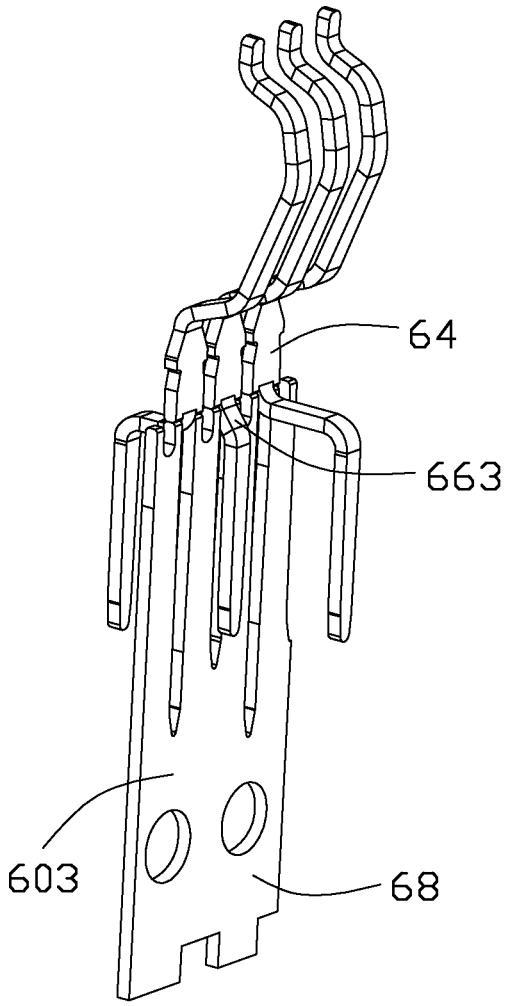
FIG. 9 is perspective view of the contacts shown in FIG. 8 before cutting from a metal plate.

Referring to FIGS. 8 and 9, in the other embodiment, the contacts 6 defines a soldering portion 66 different from the contacts 2 in the first embodiment. The contacts 6 are also cut and bended from a metal plate 603 and arranged two arrays in corresponding insulative housing (not shown). Each array of the contacts 6 is formed of the same metal plate 603 and includes retaining portions 64 which are coplanar to each other and disposed at a vertical plane in the longitudinal direction. One contact unit 601 of the contacts 6 also includes three different contacts, in which the first contact 611 and the third contact 613 are respectively deviate from the retaining portion 64 thereof towards opposite sides. But the middle second contact 612 is deviate from the retaining portion 64 thereof towards which are not coplanar to the retaining portion 64 thereof.

A strip portion 68 connects with the end of the retaining portion 64 and break off finally in the longitudinal direction, after the contacts 2 are inserted into the insulative housing 1. The soldering tail 66 of the first contact 611 and the third contact 613 both has a horizontal portion 661 and a vertical portion 662. While the horizontal portion 661 of the first contact 611 and the third contact 613 have a different length in the width direction. The second contact 612 defines an inclined bending portion 663 closer to the longer horizontal portion 661 and a vertical portion 664 bending from the inclined bending portion 663 for providing a moving space in that the strip portion 68 breaks off from the retaining portion 64 in the longitudinal direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector for being mounted on a printed circuit board (PCB), comprising:

a longitudinal insulative housing comprising a pair of sidewalls and an inserting slot therebetween for receiving a memory module;

a plurality of contacts arranged two arrays along a longitudinal direction, respectively being disposed at the both sidewalls while opposite to each other in a width direction perpendicular to the longitudinal direction, each contact comprising a retaining portion retained in the insulative housing, a contacting portion extending to the inserting slot from one end of the retaining portion and a soldering tail extending outwards from another end of the retaining portion for being soldered to the PCB; and wherein the retaining portion of each array contact are coplanar to each other and disposed at a vertical plane in the longitudinal direction, while the soldering tails of each array contact are arranged at least three tail lines.

2. The card edge connector as described in claim 1, wherein in the width direction the three tail lines defines an equal distance between of the adjacent two tail lines thereof.

3. The card edge connector as described in claim 1, wherein the soldering tails of each array contact comprises a plurality of inclined tail lines intersecting with the longitudinal tail lines.

4. The card edge connector as described in claim 3, wherein the inclined tail line is running through the solder tails of the other array contact on the diagonally opposite side thereof.

5. The card edge connector as described in claim 1, wherein each array of the contacts is formed of the same metal plate which forms a strip portion connecting with the end of the soldering tail.

6. The card edge connector as described in claim 5, wherein the strip portion breaks off from the soldering tail in the width direction after the contacts are inserted into the insulative housing.

7. A card edge connector for mounted on a printed circuit board (PCB), comprising:

a longitudinal insulative housing comprising an inserting slot therebetween for receiving a memory module;

a plurality of contacts arranged two arrays along a longitudinal direction while opposite to each other in a width direction perpendicular to the longitudinal direction, each array contact comprising a plurality of contact units which comprises a first contact, a second contact and a third contact adjacent to each other, in which the second contact is disposed between the first contact and the third contact, each contact comprising a retaining portion retained in the insulative housing and a soldering tail extending outwards from another end of the retaining portion for being soldered to the PCB; and wherein the soldering tail of second contact is coplanar to the retaining portion thereof, in the width direction the soldering tail of second contact is between of the soldering tails of the first contact and the third contact because the latter two soldering tails respectively bend and deviate from the retaining portion thereof towards opposite direction which are not coplanar to the retaining portion thereof.

8. The card edge connector as described in claim 7, wherein in the width direction the soldering tail of second contact is at middle of the soldering tails of the first contact and the third contact.

9. The card edge connector as described in claim 7, wherein the soldering tail of the first contact forms a horizontal portion bending and extending perpendicularly from the retaining portion and a vertical portion extending downwards perpendicularly from the horizontal portion for inserting into and soldering with the PCB.

10. The card edge connector as described in claim 9, wherein the soldering tail of the third contact has a horizontal portion and a vertical portion which are symmetry to the first contact, thereby the soldering tails of the first contacts and the third contacts are respectively arranged a tail line in the longitudinal direction.

11. The card edge connector as described in claim 10, wherein the soldering tails of the second contacts are arranged a tail line is middle of the two tail lines formed by the first contact and the third contact.

12. The card edge connector as described in claim 8, wherein each array of the contacts is formed of the same metal plate which forms a strip portion connecting with the end of the retaining portion and break off from the retaining portion in the longitudinal direction, after the contacts are inserted into the insulative housing.

13. The card edge connector as described in claim 12, wherein the horizontal portion of the first contact and the third contact comprises a different length in the width direction, the second contact defines an inclined bending portion bending from the retaining portion thereof and closer to the longer horizontal portion.

14. A card edge connector comprising:

an elongated insulative housing defining a center slot extending along a lengthwise direction and communicating with an exterior in a vertical direction perpendicular to said lengthwise direction;

two rows of passageways disposed in the housing by two sides of the center slot in a transverse direction perpendicular to both said lengthwise direction and said vertical direction;

a plurality of contacts disposed in the corresponding passageways, respectively, each of said contacts including an upper contacting section extending into the center slot, a lower tail section exposed below a bottom side of the housing, and a middle planar retention section therebetween; wherein the retention sections of said contacts in one row are aligned and coplanar with one another along the lengthwise direction while the tail sections of said contacts in said row are arranged with groups sequentially along said row, each group including at least two tails sections offset from each other in said transverse direction so that all tails sections are arranged in generally a staggered manner and respectively located by two opposite sides of the retention sections viewed along said lengthwise direction.

15. The card edge connector as claimed in claim 14, wherein each group includes three tail sections at three different positions in said transverse direction.

16. The card edge connector as claimed in claim 15, wherein each of said passageways is configured and dimensioned to allow the corresponding contact to be upwardly assembled thereinto from said bottom side of the housing, and is configured with a rectangular opening at the bottom side of the housing under condition that said retention section is located not at a centerline of said opening measured in the transverse direction.

17. The card edge connector as claimed in claim 16, wherein said retention section is located closer to an outer side of said opening.

18. The card edge connector as claimed in claim 15, wherein in said three tail section of each group, a first one is offset from the corresponding retention section in a first transverse direction, a second one is coplanar with the corresponding retentions section, and a third one is offset from the corresponding retention section in a second direction opposite to the first direction.

19. The card edge connector as claimed in claim 15, wherein in said three tail sections of each group, one is offset from the corresponding retention section in a first transverse direction while other two are offset from the corresponding retention sections in a second transverse direction opposite to said first transverse direction with different distances.

* * * * *